US007572563B2

(12) United States Patent
Kanamaru et al.

(10) Patent No.: US 7,572,563 B2
(45) Date of Patent: Aug. 11, 2009

(54) TONER FOR ELECTROSTATIC IMAGE DEVELOPMENT

(75) Inventors: Yutaka Kanamaru, Wakayama (JP); Koji Kameyama, Wakayama (JP)

(73) Assignee: Kao Corporation, Tokyo (JP)

( * ) Notice: Subject to any disclaimer, the term of this patent is extended or adjusted under 35 U.S.C. 154(b) by 260 days.

(21) Appl. No.: 11/563,856

(22) Filed: Nov. 28, 2006

(65) Prior Publication Data

US 2007/0190440 A1 Aug. 16, 2007

(30) Foreign Application Priority Data

Dec. 19, 2005 (JP) ..... 2005-364820

(51) Int. Cl.
*G03G 9/08* (2006.01)

(52) U.S. Cl. ..... 430/108.2; 430/108.3

(58) Field of Classification Search ..... 430/108.2, 430/108.3

See application file for complete search history.

(56) References Cited

U.S. PATENT DOCUMENTS

| | | | | |
|---|---|---|---|---|
| 5,378,571 | A * | 1/1995 | Macholdt et al. | 430/108.2 |
| 5,403,690 | A * | 4/1995 | Kuramoto et al. | 430/108.2 |
| 5,925,487 | A * | 7/1999 | Fawkes et al. | 430/108.24 |

FOREIGN PATENT DOCUMENTS

| | | |
|---|---|---|
| JP | 6-501566 | 2/1994 |
| JP | 7-234546 | 9/1995 |
| JP | 10-221879 | 8/1998 |

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner for electrostatic image development containing a resin binder, a charge control agent, and a colorant, and wherein the charge control agent contains a metal complex of a salicylic acid compound and a quaternary ammonium salt of a carboxylic acid. The toner for electrostatic image development of the present invention is suitably used in, for example, development of a latent image or the like formed in electrophotography, electrostatic recording method, electrostatic printing method, or the like.

15 Claims, No Drawings

TONER FOR ELECTROSTATIC IMAGE DEVELOPMENT

FIELD OF THE INVENTION

The present invention relates to a toner for electrostatic image development used, for example, for the development of a latent image formed in electrophotography, electrostatic recording method, electrostatic printing method, or the like.

BACKGROUND OF THE INVENTION

In order to obtain stable triboelectric chargeability of a toner for electrostatic image development, a technique in which a negatively chargeable charge control agent and a positively chargeable charge control agent are used in combination has been employed. In particular, when a polyester is used as a resin binder, the resulting toner is excellent in the aspects of transparency and low-temperature fixing ability has been known. However, since the polyester itself has triboelectric chargeability, change in triboelectric charges due to continuous printing is likely to take place.

JP-A-Hei-10-221879 discloses a toner containing a positively chargeable charge control agent and a negatively chargeable charge control agent, the toner having specified circularity and particle size distribution, as a means to improve lowering of image density, cleanability, initial rise of triboelectric charge, and triboelectric charge, in addition to the above disadvantages.

JP-A-Hei-7-234546 discloses a developer containing a metal complex compound of salicylic acid and a quaternary ammonium salt as a developer for development of an electrostatic latent image at a low-potential contrast.

JP-A-Hei-6-501566 discloses a quaternary ammonium salt of dithiodibenzoic acid as a charge control agent.

SUMMARY OF THE INVENTION

The present invention relates to a toner for electrostatic image development containing a resin binder, a charge control agent, and a colorant, and wherein the charge control agent contains a metal complex of a salicylic acid compound and a quaternary ammonium salt of a carboxylic acid.

DETAILED DESCRIPTION OF THE INVENTION

The present invention relates to a toner for electrostatic image development which is excellent in cleanability.

The toner for electrostatic image development of the present invention exhibits an excellent effect in cleanability.

These and other advantages of the present invention will be apparent from the following description.

Toners described in JP-A-Hei-7-234546 and JP-A-Hei-6-501566 have some disadvantages that cleanability of remaining toner without being transferred on a photoconductor or an intermediate transfer member is lowered when development at low printing density is carried out for a long period of time. Although not wanting to be limited by theory, the reasons therefor are presumably as follows. When the development at low printing density is continued, a toner detained in a developing machine for a long period of time is increased, and an external additive on a toner surface is embedded in a toner by an applied stress in the developing machine, so that triboelectric chargeability on a toner surface is uneven, and whereby aggregation of a toner or the like is likely to be generated. As a result, the developing machine is less likely to be cleaned electrostatically or mechanically. JP-A-Hei-10-221879 intends to overcome the disadvantage by adjustments of circularity and particle size distribution of a toner. However, in order to control circularity and particle size distribution of a toner, specialized pulverizer and classifier or a specialized apparatus after pulverization and classification is necessitated. Therefore, the development of a toner excellent in cleanability which can be produced by an ordinary method without using a specialized apparatus has been earnestly desired.

One of the significant features of the toner for electrostatic image development of the present invention resides in that the toner contains a metal complex of a salicylic acid compound and a quaternary ammonium salt of a carboxylic acid as charge control agents, in addition to a resin binder and a colorant, thereby providing excellent cleanability. Although not wanting to be limited by theory, the detailed reasons for providing excellent cleanability in the toner of the present invention are not elucidated, they are presumably as follows. The electric charge of an overall toner is stabilized to some extent by using a negatively chargeable charge control agent and a positively chargeable charge control agent together as those of conventional techniques. Further in the present invention, it is considered that by using a metal complex of a salicylic acid compound having a carboxyl group as a negatively chargeable charge control agent and a quaternary ammonium salt of a carboxylic acid as a positively chargeable charge control agent together, the electric charges of the toner are evenly dispersed so that the electric charges are less localized than those of conventional level. Therefore, the triboelectric charges on a toner surface are evened, so that toners themselves are inhibited from being aggregated even when an external additive on a toner surface is embedded in a toner, and whereby cleanability is improved. In general, a cleaning method of a toner remaining on a photoconductor or an intermediate transfer member includes a cleaning method utilizing electrostatic energy, magnetic energy, mechanical energy, or the like. The toner of the present invention exhibits a more remarkable effect for a cleaning method utilizing electrostatic energy or mechanical energy, for example, for cleaning by means of a fur-brush method or a blade method. In addition, the present invention is more useful for a pulverized toner with a low degree of circularity, particularly a pulverized toner not subjected to conglobational treatment.

The metal complex of a salicylic acid compound is preferably a metal complex of a salicylic acid compound represented by the formula (I):

(I)

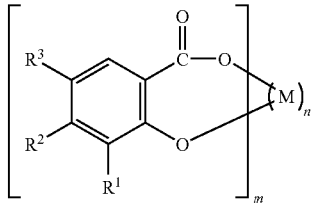

wherein each of $R^1$, $R^2$ and $R^3$ is independently a hydrogen atom, or a linear or a branched, alkyl group having 1 to 10 carbon atoms or alkenyl group having 2 to 10 carbon atoms; M is zinc, zirconium, chromium, aluminum, copper, nickel, or cobalt; m is an integer of 2 or more; and n is an integer of 1 or more.

In the formula (I), $R^2$ is preferably a hydrogen atom, and each of $R^1$ and $R^3$ is preferably a branched alkyl group, and more preferably a tert-butyl group.

M is preferably zinc or chromium which has high electronegativity and an excellent effect of giving chargeability, and more preferably chromium.

Commercially available products of chromium complexes of a salicylic acid compound which are suitably used in the present invention in which $R^2$ is a hydrogen atom, and each of $R^1$ and $R^3$ is a tert-butyl group include "BONTRON E-81" (commercially available from Orient Chemical Co., Ltd.) and the like, and commercially available products of zinc complexes of a salicylic acid compound which are suitably used in the present invention in which $R^2$ is a hydrogen atom, and each of $R^1$ and $R^3$ is a tert-butyl group include "BONTRON E-84" (commercially available from Orient Chemical Co., Ltd.) and the like.

The metal complex of a salicylic acid compound is contained in an amount of preferably from 0.1 to 10 parts by weight, and more preferably from 0.5 to 7 parts by weight, based on 100 parts by weight of the resin binder.

The quaternary ammonium salt of a carboxylic acid is preferably a compound represented by the formula (II):

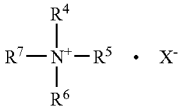

(II)

wherein each of $R^4$ to $R^7$, which may be identical or different, is a lower alkyl group having 1 to 8 carbon atoms which may be substituted by a halogen atom, an alkyl group or an alkenyl group having 8 to 22 carbon atoms, or an aryl group having 6 to 20 carbon atoms or an aralkyl group having 7 to 20 carbon atoms; and $X^-$ is a carboxylate ion.

In the present invention, from the viewpoint of giving a toner more stable triboelectric chargeability and more improved fixing ability, each of $R^4$ to $R^7$ is preferably a lower alkyl group having 1 to 4 carbon atoms which may be substituted by a halogen atom, an alkyl group having 12 to 18 carbon atoms, or a phenyl group and a benzyl group, and $X^-$ is preferably an aromatic carboxylate ion and an aliphatic carboxylate ion, and more preferably an aromatic carboxylate ion. The aromatic carboxylate ion includes a carboxylate ion having a benzoic acid backbone.

A carboxylic acid having a benzoic acid backbone includes benzoic acid, dithiodibenzoic acid, and the like.

Further, a more preferred quaternary ammonium salt of dithiodibenzoic acid includes a compound represented by the formula (IIa):

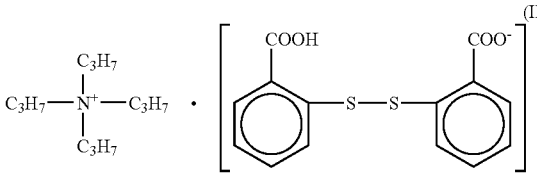

(IIa)

in the present invention.

Commercially available products containing the compound represented by the formula (IIa) include "COPY CHARGE PSY" (commercially available from Clariant (Japan) K.K.) and the like.

The quaternary ammonium salt of a carboxylic acid is contained in an amount of preferably from 0.1 to 2 parts by weight, and more preferably from 0.1 to 1 parts by weight, based on 100 parts by weight of the resin binder.

A weight ratio of the metal complex of a salicylic acid compound to the quaternary ammonium salt of a carboxylic acid, i.e., the metal complex of a salicylic acid compound/the quaternary ammonium salt of a carboxylic acid, is preferably from 99/1 to 70/30, and more preferably from 95/5 to 80/20, from the viewpoint of adjusting triboelectric charges to an appropriate level.

The metal complex of a salicylic acid compound and the quaternary ammonium salt of a carboxylic acid are contained in a total amount of preferably from 0.2 to 12 parts by weight, more preferably from 1 to 10 parts by weight, and even more preferably from 3 to 8 parts by weight, based on 100 parts by weight of the resin binder.

The resin binder in the present invention includes polyesters, vinyl resins such as styrene-acrylic resins, epoxy resins, polycarbonates, polyurethanes, hybrid resins having two or more resin components, and the like. Among them, the polyester is preferable, but not particularly limited thereto. When the polyester is used as the resin binder, it is considered that the charges on the toner surface are more evened due to synergism of a carboxyl group of the polyester and a carboxyl group of the charge control agent, so that the effect of the present invention is more remarkably exhibited. The polyester is contained in an amount of preferably from 50 to 100% by weight, more preferably from 70 to 100% by weight, and even more preferably substantially 100% by weight, of the resin binder.

A raw material monomer for the polyester is not particularly limited, as long as a known alcohol component and a known carboxylic acid component such as a carboxylic acid, an anhydride thereof, or an ester thereof are used.

The alcohol component includes alkylene (2 or 3 carbon atoms) oxide (average number of moles: 1 to 16) adducts of bisphenol A, such as polyoxypropylene(2.2)-2,2-bis(4-hydroxyphenyl)propane and polyoxyethylene(2.2)-2,2-bis(4-hydroxyphenyl)propane, ethylene glycol, propylene glycol, glycerol, pentaerythritol, trimethylolpropane, hydrogenated bisphenol A, sorbitol, or alkylene (2 to 4 carbon atoms) oxide (average number of moles: 1 to 16) adducts thereof, and the like.

In addition, the carboxylic acid component includes dicarboxylic acids such as phthalic acid, isophthalic acid, terephthalic acid, fumaric acid, maleic acid, adipic acid, and succinic acid; a substituted succinic acid of which substitutent is an alkyl group having 1 to 20 carbon atoms or an alkenyl group having 2 to 20 carbon atoms, such as dodecenylsuccinic acid or octenylsuccinic acid; tricarboxylic or higher polycarboxylic acids such as trimellitic acid and pyromellitic acid; acid anhydrides thereof, alkyl (1 to 3 carbon atoms) esters thereof, and the like.

The polyester can be produced by, for example, polycondensation of the alcohol component and the carboxylic acid component at a temperature of from 180° to 250° C. in an inert gas atmosphere, using an esterification catalyst as desired.

It is preferable that the polyester has a softening point of from 80° to 165° C., a glass transition temperature of from 50° to 85° C., and an acid value of from 0.5 to 60 mgKOH/g, from the viewpoint of durability and fixing ability.

As the colorant, a dye, a pigment, or the like which is used as a colorant for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, Disazoyellow, and the like. These colorants can be used alone or in admixture of two or more kinds. The toner of the present invention may be any of black toners, color toners, and full-color toners. The colorant is contained in an amount of preferably from 1 to 40 parts by weight, and more preferably from 3 to 10 parts by weight, based on 100 parts by weight of the resin binder.

Further, the toner of the present invention may appropriately contain an additive such as a releasing agent, an electric conductivity modifier, an extender, a reinforcing filler such as a fibrous substance, an antioxidant, an anti-aging agent, or a magnetic material.

The toner of the present invention can be produced according to a known method such as a kneading-pulverization method, an emulsion aggregation method, a spray-drying method, or a polymerization method. From the viewpoint of more remarkably exhibiting the effect of the present invention, the kneading-pulverization method is preferable, and the kneading-pulverization method without employing conglobational treatment is even more preferable. A general method for producing a pulverized toner according to the kneading-pulverization method includes, for example, a method including the steps of homogeneously mixing a resin binder, a colorant, a charge control agent, and the like in a mixer such as a ball-mill, thereafter melt-kneading with a closed kneader, a single-screw or twin-screw extruder or the like, cooling, pulverizing and classifying the product. The metal complex of a salicylic acid compound and the quaternary ammonium salt of a carboxylic acid, which are the charge control agents in the present invention, may be simultaneously mixed with the resin binder, or the one of the charge control agents may be mixed with the resin binder and thereafter the other one may be mixed with the mixture. In addition, the method including the steps of previously mixing charge control agents with a resin to give a masterbatch, and mixing the masterbatch with a resin binder, a colorant, or the like in a mixer such as a ball-mill can be used. Further, a fluidity improver, such as a hydrophobic silica, or the like may be optionally added to a roughly pulverized product during the production process, or to a surface of the resulting toner. The toner of the present invention has a volume-median particle size ($D_{50}$) of preferably from 3 to 15 μm, and more preferably from 4 to 9 μm. The term "volume-median particle size ($D_{50}$)" as used herein refers to a particle size of which cumulative volume frequency calculated on a volume percentage is 50% counted from the smaller particle sizes.

The toner for electrostatic image development of the present invention can be either directly used as a monocomponent toner for development in a monocomponent developing method, or used as a two-component developer in which the toner mixed with a carrier in a two-component developing method.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Glass Transition Temperature of Resin]

The glass transition temperature refers to a temperature of an intersection of the extension of the baseline of equal to or lower than the temperature of the endothermic highest peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Value of Resin]

The acid value is determined by a method according to JIS K 0070.

[Volume-Median Particle Size ($D_{50}$) of Toner]

Measuring Apparatus Coulter Multisizer II (commercially available from Beckman Coulter K.K.)

Aperture Diameter: 100 μm

Range of Particle Sizes to Be Determined: 2 to 60 μm

Analyzing Software: Coulter Multisizer AccuComp Ver. 1.19 (commercially available from Beckman Coulter K.K.)

Electrolytic solution: "Isotone II" (commercially available from Beckman Coulter K.K.)

Dispersion: A 5% electrolytic solution of "EMULGEN 109P" (commercially available from Kao Corporation, polyoxyethylene lauryl ether, HLB: 13.6)

Dispersion Conditions Ten milligrams of a test sample is added to 5 ml of the above dispersion, and the resulting mixture is dispersed in an ultrasonic disperser for 1 minute. Thereafter, 25 ml of the electrolytic solution is added to the dispersion, and the resulting mixture is dispersed in the ultrasonic disperser for another 1 minute.

Measurement Conditions: One-hundred milliliters of the electrolytic solution and the dispersion are added to a beaker, and the particle sizes of 30,000 particles are determined under the conditions for concentration satisfying that the determination for 30,000 particles are completed in 20 seconds. The volume-median particle size ($D_{50}$) is obtained from the particle size distribution.

Production Example 1 for Resin

A 5 liter-four-neck flask equipped with a nitrogen inlet tube, a dehydration tube, a stirrer, and a thermocouple was charged with 1,705 g of polyoxypropylene(2.2)-2,2-bis(4-hydroxyphenyl)propane, 328 g of terephthalic acid, 1,050 g of fumaric acid, and 2.5 g of dibutyltin oxide. The ingredients in the flask were reacted at 230° C. for 8 hours, and further reacted at 8.3 kPa until the desired softening point was reached, to give a polyester A. The resulting polyester A had a softening point of 109° C., a glass transition temperature of 64° C., and an acid value of 18 mgKOH/g.

Examples 1 to 3 and Comparative Examples 1 to 3

One-hundred parts by weight of the polyester A, charge control agents as shown in Table 1, 5 parts by weight of a magenta pigment "Fastogen Super Magenta R" (commercially available from Dainippon Ink and Chemicals Incorporated), and 2 parts by weight of a polyolefin wax "Hi-wax NP-105" (commercially available from MITSUI CHEMICALS, INC.) were mixed in a Henschel mixer. Thereafter, the mixture was melt-kneaded using a twin-screw extruder and cooled. Thereafter, the cooled mixture went through ordinary pulverizing and classifying steps (using a type I pulverizer and a DS classifier), to give a toner with the volume-median particle size ($D_{50}$) as shown in Table 1. Further, 0.6 parts by weight of a hydrophobic silica "R-972" (commercially available from Nippon Aerosil) was added to 100 parts by weight of the resulting toner, and the mixture was mixed with a Henschel mixer. Thereafter, the mixture was sieved through a wire mesh having a sieve opening of 100 μm, to give a toner subjected to external addition treatment.

Test Example

A 1-liter cylindrical plastic bottle was charged with 48 g each of the resulting toner obtained in each example and each comparative example, and 756 g of a ferrite carrier. Thereafter, the plastic bottle was fixed in a Turbula shaker-mixer, and rotated for 10 minutes at a rate of 90 r/min, to give a two-component developer.

The resulting developer was loaded on a commercially available copy machine "AR-S330" (commercially available from Sharp Corporation), and the developer was stirred for 1 hour at simulation mode. An original printout containing a solid image was set on the copy machine to copy 10 sheets, and a photoconductor was then taken out. A toner remaining on a part on a surface of the photoconductor, the part in which a toner image corresponding to the solid image was formed, was transferred to a mending tape. The mending tape and an unused mending tape were adhered to a white sheet, respectively. The image densities of both used and unused mending tapes were determined with a calorimeter "GRETAG SPM50" (commercially available from Gretag Macbeth AG), and the difference in image densities was obtained. The results are shown in Table 1. It is shown that the larger the difference in image densities, the larger the amount of toner remaining on the surface of the photoconductor even after termination of copying, and the worse the cleanability.

TABLE 1

| | Volume-Median Particle Size ($D_{50}$) | Negatively Chargeable Charge Control Agent BONTRON E-81 | BONTRON E-84 | LR-147 | Positively Chargeable Charge Control Agent Copy Charge PSY | BONTRON P-51 | Difference in Image Densities (Cleanability) |
|---|---|---|---|---|---|---|---|
| Ex. 1 | 8.63 | parts by weight | — | — | 0.5 parts by weight | — | 0.04 |
| Ex. 2 | 8.3 | — | 3 parts by weight | — | 0.5 parts by weight | — | 0.07 |
| Ex. 3 | 8.4 | 6 parts by weight | — | — | 0.8 parts by weight | — | 0.03 |
| Comp. Ex. 1 | 8.5 | 3 parts by weight | — | — | — | — | 0.17 |
| Comp. Ex. 2 | 8.6 | 3 parts by weight | — | — | — | 0.5 parts by weight | 0.15 |
| Comp. Ex. 3 | 8.4 | — | — weight | 3 parts by weight | 0.5 parts by | — | —[1)] |

Note) BONTRON E-81: A chromium complex of di-t-butyl salicylic acid (commercially available from Orient Chemical Co., Ltd)
BONTRON E-84: A zinc complex of di-t-butyl salicylic acid (commercially available from Orient Chemical Co., Ltd)
LR-147: A boron complex of benzilic acid (commercially available from Japan Carlit)
Copy Charge PSY: A compound represented by the above formula (IIa) (commercially available from Clariant (Japan) K.K.)
BONTRON P-51: A compound represented by the following formula (III) (commercially available from Orient Chemical Co., Ltd)
1) A toner could not be developed because triboelectric charges are too low.

(III)

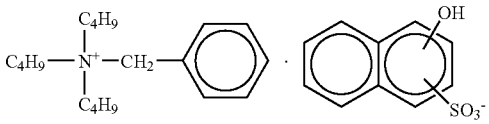

It can be seen from the above results that any one of the toners of Examples 1 to 3 have excellent cleanability as compared to the toners of Comparative Examples 1 to 3.

The toner for electrostatic image development of the present invention is suitably used in, for example, for development of a latent image or the like formed in electrophotography, electrostatic recording method, electrostatic printing method or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising a resin binder, a charge control agent, and a colorant, and wherein said charge control agent comprises a metal complex of a salicylic acid compound and a quaternary ammonium salt of a carboxylic acid having a benzoic acid backbone.

2. The toner according to claim 1, wherein the carboxylic acid having a benzoic acid backbone is dithiodibenzoic acid.

3. The toner according to claim 1, wherein the quaternary ammonium salt of a carboxylic acid is contained in an amount of from 0.1 to 2 parts by weight, based on 100 parts by weight of the resin binder.

4. The toner according to claim 1, wherein the metal complex of a salicylic acid compound is a compound represented by the formula (I):

(I)

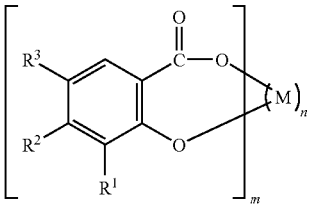

wherein each of $R^1$, $R^2$ and $R^3$ is independently a hydrogen atom, or a linear or branched, alkyl group having 1 to 10 carbon atoms or alkenyl group having 2 to 10 carbon atoms; M is zinc, zirconium, chromium, aluminum, copper, nickel, or cobalt; m is an integer of 2 or more; and n is an integer of 1 or more.

5. The toner according to claim 1, wherein the metal complex of a salicylic acid compound is a chromium complex of a salicylic acid compound.

6. The toner according to claim 1, wherein the metal complex of a salicylic acid compound is contained in an amount of from 0.1 to 10 parts by weight, based on 100 parts by weight of the resin binder.

7. The toner according to claim 1, wherein the resin binder comprises a polyester.

8. The toner according to claim 1, wherein a weight ratio of the metal complex of a salicylic acid compound to the quaternary ammonium salt of a carboxylic acid is from 99/1 to 70/30.

9. The toner according to claim 1, wherein the quaternary ammonium salt of a carboxylic acid is a compound of formula $[NR^4R^5R^6R^7]^+ \cdot X^-$, wherein each of $R^4$, $R^5$, $R^6$ and $R^7$ is a hydrocarbon group having from 1 to 22 carbon atoms.

10. The toner according to claim 1, wherein the metal complex of a salicylic acid compound comprises di-t-butyl salicylic acid.

11. The toner according to claim 10, wherein the metal complex of a salicylic acid compound further comprises at least one of Cr and Zn.

12. The toner according to claim 1, wherein the quaternary ammonium salt of a carboxylic acid comprises a dithiodibenzoic acid.

13. The toner of claim 12, wherein the quaternary ammonium salt of a carboxylic acid further comprises a tetra-propyl ammonium group.

14. The toner of claim 1, wherein the metal complex of the salicylic acid compound is present in an amount of from 3 to 6 parts by weight based on 100 parts by weight of the resin binder.

15. The toner of claim 14, wherein the quaternary ammonium salt of the carboxylic acid is present in an amount of from 0.5 to 0.8 parts by weight based on 100 parts by weight of the resin binder.

* * * * *